US008965264B2

(12) United States Patent
Nakane et al.

(10) Patent No.: US 8,965,264 B2
(45) Date of Patent: Feb. 24, 2015

(54) BLADE MEMBER, CLEANER AND IMAGE FORMING APPARATUS

(75) Inventors: Yoshiki Nakane, Toyokawa (JP); Kuniaki Kashiwakura, Toyohashi (JP); Yohei Ito, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 96 days.

(21) Appl. No.: 13/424,435

(22) Filed: Mar. 20, 2012

(65) Prior Publication Data

US 2012/0243915 A1 Sep. 27, 2012

(30) Foreign Application Priority Data

Mar. 23, 2011 (JP) ..... 2011-064479

(51) Int. Cl.
*G03G 21/00* (2006.01)

(52) U.S. Cl.
CPC ..... *G03G 21/0017* (2013.01); *G03G 2221/001* (2013.01)
USPC ..... 399/350; 399/346

(58) Field of Classification Search
USPC ..... 399/101, 346, 350, 351
See application file for complete search history.

(56) References Cited

U.S. PATENT DOCUMENTS

| | | | | |
|---|---|---|---|---|
| 6,473,589 | B2 * | 10/2002 | Hisakuni | 399/350 |
| 6,704,539 | B2 | 3/2004 | Nakayama | |
| 7,254,364 | B2 * | 8/2007 | Nakayama | 399/350 X |
| 7,418,231 | B2 * | 8/2008 | Ueno et al. | 399/350 |
| 7,542,712 | B2 * | 6/2009 | Tanaka et al. | 399/346 |
| 2009/0028618 | A1 * | 1/2009 | Kabata et al. | 399/346 |

FOREIGN PATENT DOCUMENTS

| | | | |
|---|---|---|---|
| JP | 2003-122213 | A | 4/2003 |
| JP | 2005-128311 | A | 5/2005 |
| JP | 2005-156696 | A | 6/2005 |
| JP | 2009-109573 | A | 5/2009 |
| JP | 2010-66333 | A | 3/2010 |

OTHER PUBLICATIONS

Official Action issued by Japanese Patent Office on Jun. 24, 2014 in Japanese Application No. 2011-064479, and English language translation of Official Action (10 pgs).

* cited by examiner

*Primary Examiner* — Sandra Brase
(74) *Attorney, Agent, or Firm* — Buchanan Ingersoll & Rooney PC

(57) ABSTRACT

A blade member having; a contact layer in contact with a surface of an image carrier; and a support layer superimposed on the contact layer, wherein a first curve indicating a relation between loss tangent and temperature of the contact layer and a second curve indicating a relation between loss tangent and temperature of the support layer intersect with each other in a temperature range of not lower than 25° C. and not higher than 45° C.

20 Claims, 4 Drawing Sheets

BLADE MEMBER, CLEANER AND IMAGE FORMING APPARATUS

This application is based on Japanese Patent Application No. 2011-064479 filed on Mar. 23, 2011, the content of which is incorporated herein by reference.

BACKGROUND OF THE INVENTION

1. Field of the Invention

The present invention relates to a blade member, a cleaner and an image forming apparatus, and more particularly relates to a blade member in contact with a surface of a photoreceptor, a cleaner, and an image forming apparatus.

2. Description of Related Art

As a conventional blade member used in an image forming apparatus, there is for example known a cleaning blade described in Japanese Patent Laid-Open Publication No. 2010-66333. The cleaning blade has a backup layer and an edge portion. The backup layer and the edge portion are made up of a polyurethane elastic material. The edge portion is in contact with a photoreceptor to clean the surface of the photoreceptor, and is provided at the tip of the backup layer.

Further, in the cleaning blade described in Japanese Patent Laid-Open Publication No. 2010-66333, the JIS-A hardness of the backup layer is set lower than the JIS-A hardness of the edge portion. By setting the hardness of the edge portion to relatively high hardness as thus described, abrasion resistance and cleaning performance of the edge portion are sought to be improved. Further, by setting the hardness of the backup layer to relatively low hardness, occurrence of eternal distortion in the backup layer is suppressed.

However, the cleaning blade described in Japanese Patent Laid-Open Publication No. 2010-66333 does not sufficiently suppress abrasion that occurs in the edge portion, as described below. The edge portion and the backup layer have different loss tangents (tan δ). When the loss tangent of the edge portion and the loss tangent of the backup layer are different, a vibration that is generated by the contact of the edge portion with the surface of the photoreceptor is reflected on a boundary between the edge portion and the backup layer. Accordingly, a stationary wave is generated in the edge portion due to the vibration generated between the edge portion and the surface of the photoreceptor and the vibration reflected on the boundary between the edge portion and the backup layer. Therefore, in addition to a stick-slip vibration which is normally generated by a slide of the edge portion sliding on the surface of the photoreceptor, a micro vibration is generated in the edge portion due to the stationary wave, thus leading to large development in abrasion of the contact layer.

SUMMARY OF THE INVENTION

A blade member according to an embodiment of the present invention comprises: a contact layer in contact with a surface of an image carrier; and a support layer superimposed on the contact layer, wherein a first curve indicating a relation between loss tangent and temperature of the contact layer and a second curve indicating a relation between loss tangent and temperature of the support layer intersect with each other in a temperature range of not lower than 25° C. and not higher than 45° C.

A cleaner according to an embodiment of the present invention is a cleaner for cleaning the surface of the image carrier, and the cleaner includes the blade member.

An image forming apparatus according to an embodiment of the present invention includes the cleaner.

BRIEF DESCRIPTION OF THE DRAWINGS

These and other features of the present invention will be apparent from the following description with reference to the accompanying drawings, in which.

DETAILED DESCRIPTION OF THE PREFERRED EMBODIMENTS

Hereinafter, a blade member, a cleaner, and an image forming apparatus according to an embodiment of the present invention will be described.

Overview of the Image Forming Apparatus

Figure 1:
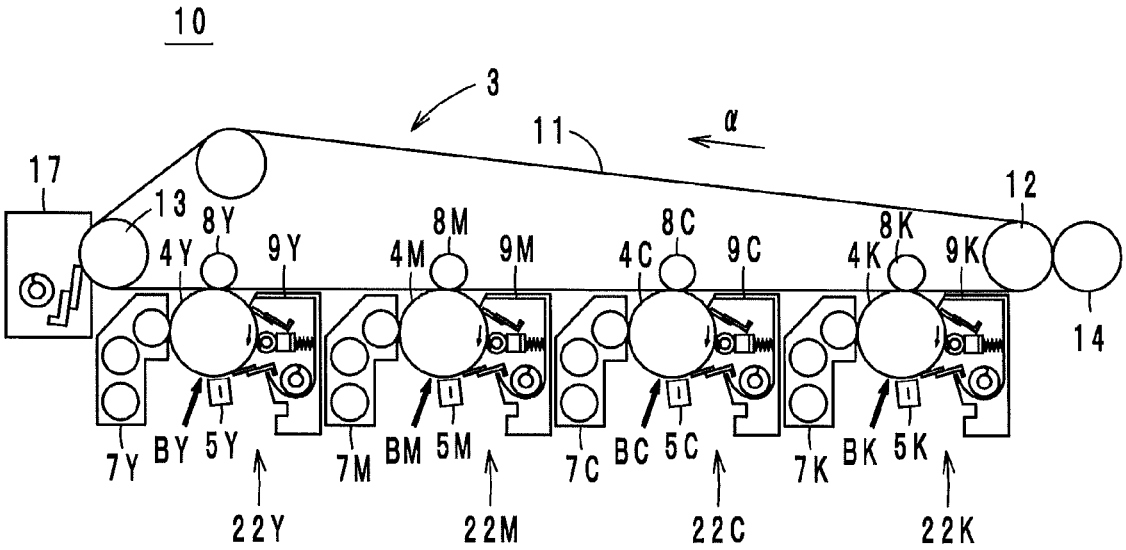
FIG. 1 is a view showing a printing section of an image forming apparatus according to an embodiment of the present invention.

FIG. 1 is a view showing a printing section 3 of an image forming apparatus 10. It is to be noted that the configuration of the image forming apparatus 10 according to the present embodiment is the same as that of a typical image forming apparatus except that the printing section 3 is different from a printing section of the typical image forming apparatus. Therefore, a description of the printing section 3 of the image forming apparatus 10 will be provided below, and descriptions of the other parts of the image forming apparatus 10 will be omitted.

An image forming apparatus 10 is an electrophotographic color printer of a so-called tandem type, which is configured so as to synthesize an image from images of four colors (Y; yellow; M: magenta; C: cyan; K: black).

The printing section 3 of the image forming apparatus 10 forms a toner image on paper being fed from a cassette (not shown), and includes an optical scanning device (not shown), a transfer section 8 (8Y, 8M, 8C, 8K), an intermediate transfer belt (image carrier) 11, a driving roller 12, a driven roller 13, a secondary transfer roller 14, a cleaner 17, and an image forming unit 22 (22Y, 22M, 22C, 22K), as shown in FIG. 1. Further, the image forming unit 22 (22Y, 22M, 22C, 22K) includes a photosensitive drum (image carrier) 4 (4Y, 4M, 4C, 4K), a charger 5 (5Y, 5M, 5C, 5K), a development unit 7 (7Y, 7M, 7C, 7K), and a cleaner 9 (9Y, 9M, 9C, 9K), as shown in FIG. 1.

The photoreceptor drum 4 (4Y, 4M, 4C, 4K) is cylindrical and is rotated clockwise in FIG. 1. The photoreceptor drum 4 is a laminated type organic photoreceptor having a charge generation layer and a charge transport layer. The outermost surface of the photoreceptor drum 4, that is, an overcoat layer has a thickness of 5 μm, and in the overcoat layer, $SiO_2$ microparticles having a particle size of 50 μm are dispersed. Therefore, the overcoat layer is uneven.

The charger 5 (5Y, 5M, 5C, 5K) charges the peripheral surface of the photosensitive drum 4 (4Y, 4M, 4C, 4K). An optical scanning apparatus (not shown) scans the peripheral surface of the photosensitive drum 4 (4Y, 4M, 4C, 4K) with a beam B (BY, BM, BC, BK) by control of a control section (not shown). Thereby, an electrostatic latent image is formed on the peripheral surface of the photosensitive drum 4 (4Y, 4M, 4C, 4K).

The developing device 7 (7Y, 7M, 7C, 7K) respectively develops toner images of Y, M, C, K based on the electrostatic latent image on the photosensitive drum 4 (4Y, 4M, 4C, 4K).

The intermediate transfer belt 11 is extended between the driving roller 12 and the driven roller 13. The transfer section 8 is arranged to face the inner peripheral surface of the intermediate transfer belt 11 and transfers the toner image formed on the photosensitive drum 4 to the intermediate transfer belt 11 (primary transfer). The cleaner 9 collects the toner remaining on the peripheral surface of the photosensitive drum 4 after the primary transfer. The toner collected by the cleaner 9 is carried as waste toner by a screw to a collection box (not shown). The cleaner 9 will be described in more detail later. The driving roller 12 is rotated by an intermediate transfer belt driving section (not shown in FIG. 1), thereby to drive the intermediate transfer belt 11 in a direction of an arrow α. In this manner, the intermediate transfer belt 11 carries the toner image to the secondary transfer roller 14.

The secondary transfer roller 14, which is cylindrical, is opposed to the intermediate transfer belt 11. A transfer voltage is applied to the secondary transfer roller 14, and thereby, the secondary transfer roller 14 transfers the toner image, being carried by the intermediate transfer belt 11, to paper passing between the intermediate transfer belt 11 and the secondary transfer roller 14 (secondary transfer). Thereafter, the cleaner 17 collects the toner remaining on the surface of the intermediate transfer belt 11.

A fixing device performs a heating treatment and a pressure treatment on the paper, to which the toner image has been transferred. The printed paper is then ejected from the image forming apparatus 10.

Configuration of the Cleaner

Figure 2:
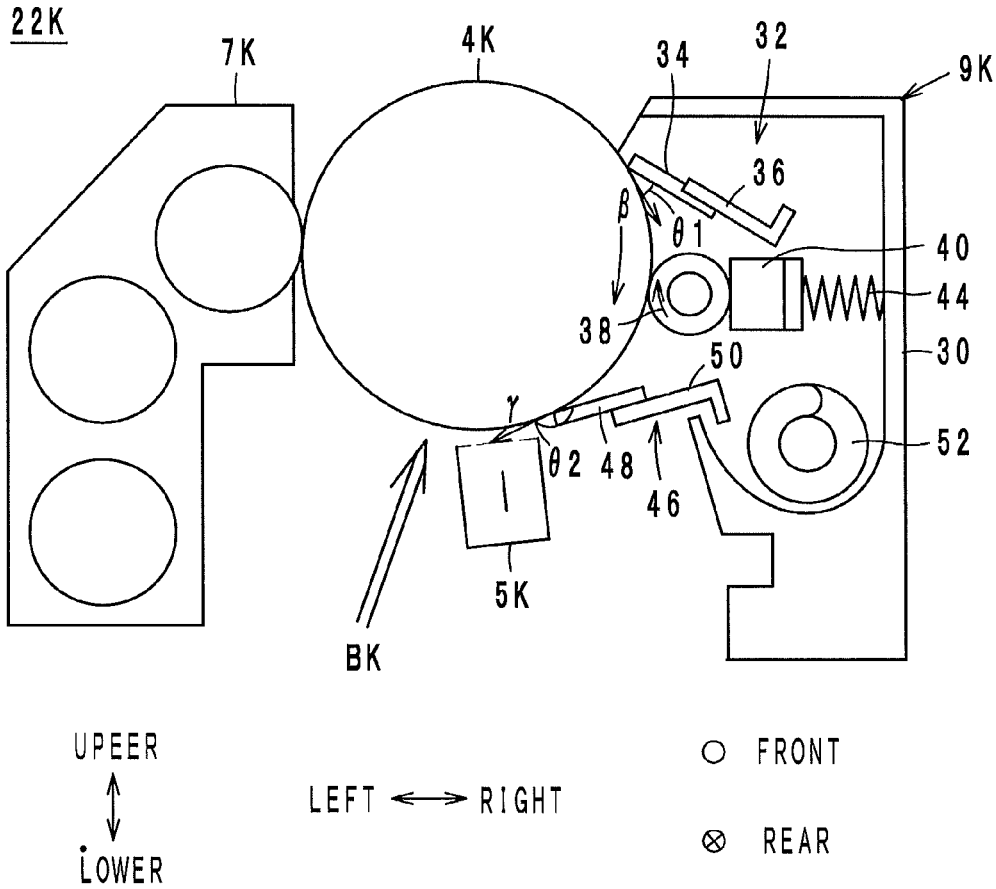
FIG. 2 is an enlarged view of the image forming unit of FIG. 1.
Figure 3:
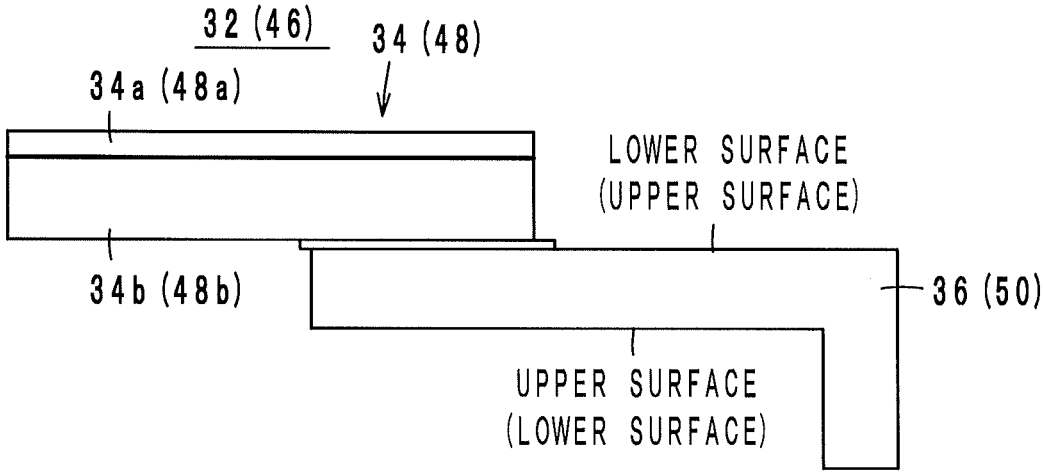
FIG. 3 is an enlarged view of a cleaning section and a leveling section of FIG. 2.

Next, the configuration of the cleaner 9 will be described with reference to the drawings. FIG. 2 is an enlarged view of an image forming unit 22K shown in FIG. 1. In the following, the words "upper" and "lower" are used with respect to the vertical direction on the paper surface of FIG. 2, and the words "right" and "left" are used with respect to the horizontal direction on the paper surface of FIG. 2. The words, "front" and "rear" are used with respect to the direction perpendicular to the paper surface of FIG. 2. FIG. 3 is an enlarged view of a cleaning section 32 and a leveling section 46 of FIG. 2. A description will be provided below, taking the cleaner 9K as an example. Since the cleaners 9Y, 9M and 9C are of the same configuration as the cleaner 9K, descriptions of the cleaners 9Y, 9M and 9C will be omitted.

As shown in FIG. 2, the cleaner 9K includes a body 30, a cleaning section 32, a brush 38, a solid lubricant 40, a press member 44, a leveling section 46 and a screw 52.

The body 30 is a housing with a hollow inside, and the cleaning section 32, the brush 38, the solid lubricant 40, the press member 44, the leveling section 46, and the screw 52 are encased in the body 30. Further, in the body 30, toner collected from the photoreceptor drum 4 is kept.

The cleaning section 32 is a cleaner for cleaning the surface of a photosensitive drum 4K, and is provided with a blade member 34 and a support member 36. The support member 36 is, for example, a metal plate bent into an L shape, and is fixed to the inside of the body 30.

The blade member 34 is fixed to the support member 36, and is in contact with the surface of the photosensitive drum 4K, thereby to scrape off the toner adhering to the surface of the photosensitive drum 4K. More specifically, as shown in FIG. 3, the blade member 34 is provided with a contact layer 34*a* and a support layer 34*b*.

The contact layer 34*a* is a polyurethane rubber sheet, and is in contact with the surface of the photosensitive drum 4K at the left end of FIG. 3. The contact layer 34*a* is arranged in a counter manner against the photosensitive drum 4K. This means that the contact layer 34*a* is in contact with the photosensitive drum 4K at an acute angle θ1 to a vector β indicating the traveling direction of the portion of the photosensitive drum 4K in contact with the contact layer 34*a*.

The support layer 34*b* is a polyurethane rubber sheet, and is superimposed on the contact layer 34*a*. The hardness of the support layer 34*b* is lower than the hardness of the contact layer 34*a*. The thickness of the support layer 34*b* is larger than the thickness of the contact layer 34*a*. Therefore, the support layer 34*b* supports the contact layer 34*a* so as to prevent easy deformation of the contact layer 34*a*. Further, as shown in FIGS. 2 and 3, the support layer 34*b* is bonded to the lower surface of the support member 36 by means of a hot-melt adhesive. The blade member 34 is thereby fixed to the inside of the body 30 through the support member 36.

The solid lubricant 40 is formed by melting and molding zinc stearate powder, and fixed to a holding member made of a sheet metal by means of a double-sided adhesive tape. The press member 44 is a compression spring, and pushes the solid lubricant 40 onto the brush 38.

As shown in FIG. 2, the brush 38 is a roll-shaped blush member in contact with the surface of the photosensitive drum 4K on a downstream side of the cleaning section 32 in a rotating direction of the photosensitive drum 4K. The axis of the brush 38 is an iron core having a diameter of 6 mm. Fibers are woven into a base fabric having a thickness of 0.5 mm. The iron core is wound with the fiber-woven fabric, and thereby, the brush 38 is constituted. Since the fibers have lengths of 2.5 mm, the brush 38 has a diameter of 12 mm. The material for the fibers of the brush 38 is conductive polyester having a resistance value of $10^6$ to $10^8$ Ω. Further, the fibers of the brush 38 have thicknesses of 4 deniers, and the fibers are woven at a density of 150 kF/inch2.

The brush 38 is rotated in the same direction as the photosensitive drum 4K, and feeds the solid lubricant 40 to the photosensitive drum 4K. Specifically, the brush 38 shaves and crushes the solid lubricant 40 into powder, and then applies the lubricant powder 40 to the photosensitive drum 4K. Since the overcoat layer of the photosensitive drum 4K is uneven, the zinc stearate powder efficiently adheres to the surface of the photoreceptor drum 4.

The leveling section 46 levels off the lubricant, applied by the brush 38 to the surface of the photosensitive drum 4K, to a uniform thickness, and is provided with a blade member 48 and a support member 50. The support member 50 is for example, a metal plate bent into an L shape, and is fixed to the inside of the body 30.

The blade member 48 is fitted to the support member 50, and is in contact with the surface of the photosensitive drum 4K to level off the lubricant, applied by the brush 38 to the surface of the photosensitive drum 4K, to a uniform thickness. More specifically, as shown in FIG. 3, the blade member 48 is provided with a contact layer 48*a* and a support layer 48*b*.

As shown in FIG. 3, the contact layer 48*a* is a polyurethane rubber sheet, and the left end of the contact layer 48*a* is in contact with the surface of the photosensitive drum 4K. The contact layer 48*a* is arranged in a trailing manner along the photosensitive drum 4K. This means that the contact layer 48*a* is in contact with the photosensitive drum 4K at an obtuse angle θ2 to a vector y indicating the traveling direction of the portion of the photosensitive drum 4K in contact with the contact layer 48*a*.

The support layer 48*b* is a polyurethane rubber sheet, and is attached below to the contact layer 48*a*. The hardness of the support layer 48*b* is lower than the hardness of the contact layer 48*a*. The thickness of the support layer 48*b* is larger than the thickness of the contact layer 48*a*. Therefore, the support layer 48*b* supports the contact layer 48*a* so as to prevent easy deformation of the contact layer 48*a*. Further, as shown in FIGS. 2 and 3, the support layer 48*b* is bonded to the upper surface of the support member 50 by means of the hot-melt adhesive. The blade member 48 is thereby fixed to the inside of the body 30 through the support member 50.

The screw 52 is extended from the rear side to the front side in the body 30, and carries waste toner collected by the cleaning section 32 to a collection box (not shown).

Characteristics of the Contact Layer and the Support Layer

Figure 4:
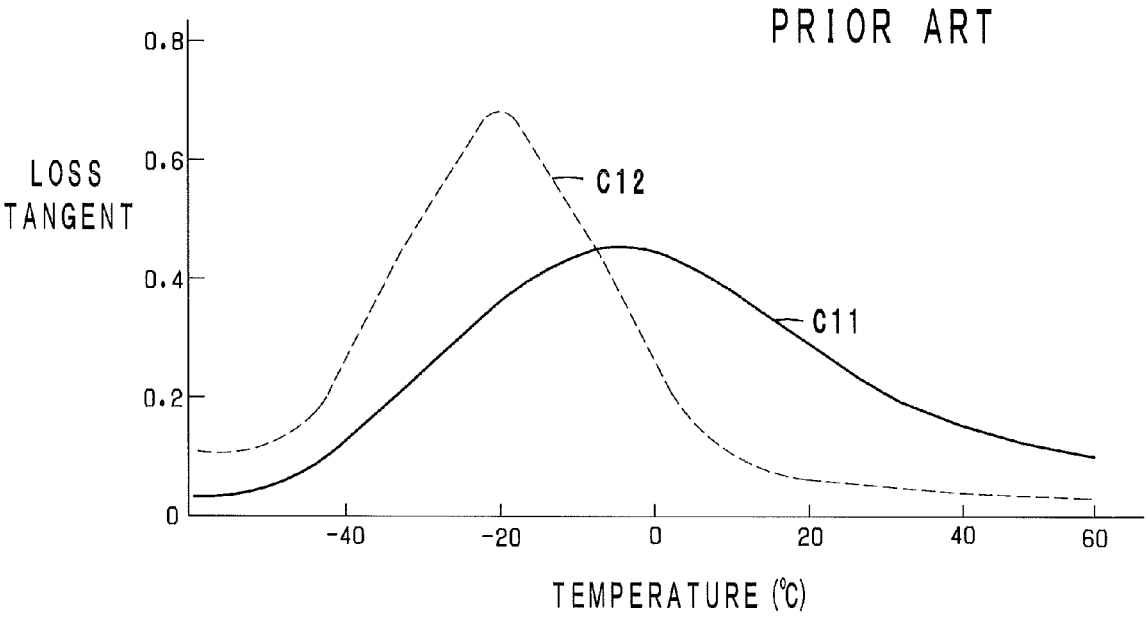
FIG. 4 is a graph showing the relation between temperature and loss tangent (tan δ) of a contact layer and that of a support layer in a conventional image forming apparatus.
Figure 5:
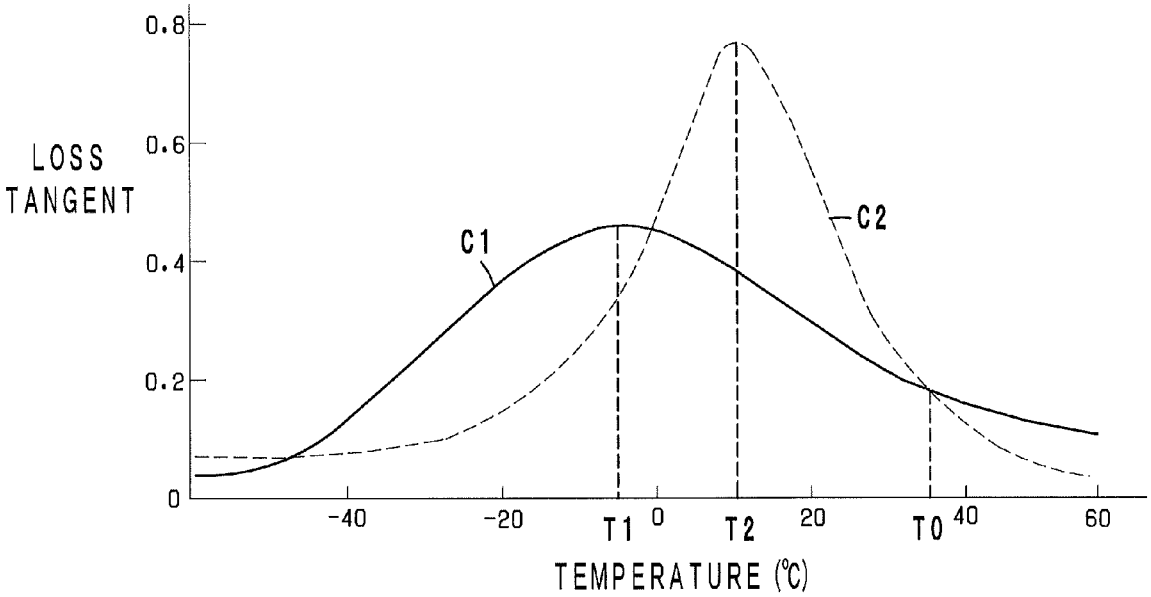
FIG. 5 is a graph showing the relation between temperature and loss tangent (tan δ) of a contact layer and that of a support layer in the image forming apparatus according to the embodiment.
Figure 6:
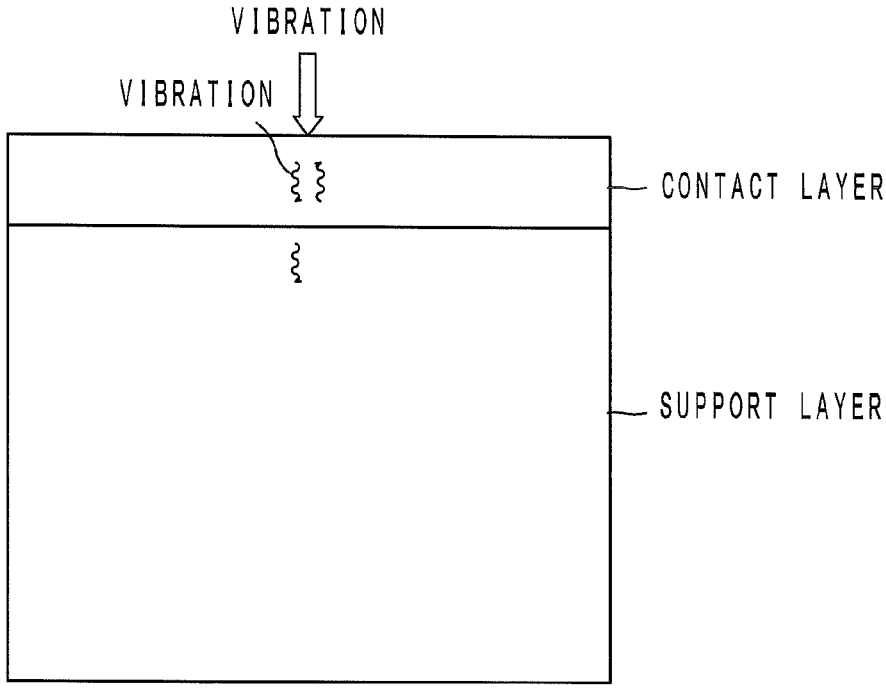
FIG. 6 PRIOR ART
FIG. 6 is a view showing a state of propagation of a vibration inputted from the contact layer in the conventional image forming apparatus.
Figure 7:
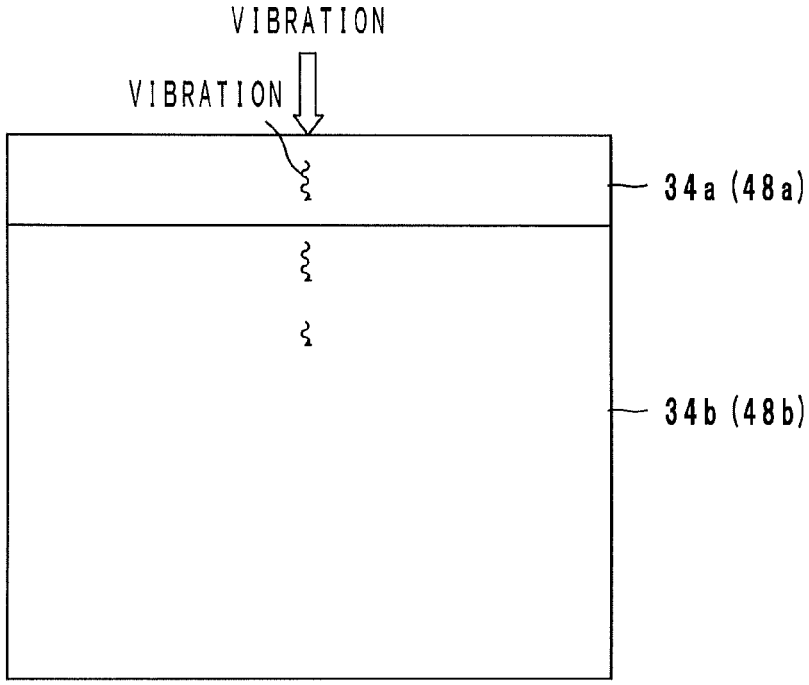
FIG. 7 is a view showing a state of propagation of a vibration inputted from the contact layer in the image forming apparatus according to the embodiment.

Characteristics of the contact layers 34*a* and 48*a* and the support layers 34*b* and 48*b* of the image forming apparatus 10 according to the present embodiment will be described in detail below. FIG. 4 is a graph showing the relation between temperature and loss tangent (tan δ) of a contact layer and that of a support layer in a conventional image forming apparatus. FIG. 5 is a graph showing the relation between temperature and loss tangent (tan δ) of the contact layers 34*a* and 48*a* and that of the support layers 34*b* and 48*b* in the image forming apparatus 10. In the graphs, the x axis indicates temperature, and the y axis indicates loss tangent (tan δ). FIG. 6 is a view showing propagation of a vibration inputted from the contact layer in the conventional image forming apparatus. FIG. 7 is a view showing propagation of a vibration inputted from the contact layers 34*a* and 48*a* in the image forming apparatus 10. The measurement of loss tangent is in accordance with the method shown in JIS K6394.

The curve C1 in FIG. 5 shows the relation between the loss tangent and the temperature of the contact layers 34*a* and 48*a*. The curve C2 shows the relation between the loss tangent and the temperature of the support layers 34*b* and 48*b*. The curve C11 in FIG. 4 shows the relation between the loss tangent and the temperature of the contact layer in the conventional image forming apparatus. The curve C12 in FIG. 4 shows the relation between the loss tangent and the temperature of the support layer.

As shown in FIGS. 4 and 5, each of the curves C1, C2, C11, C12 indicating the relation between the loss tangent and the temperature is a bell-shaped curve, wherein the loss tangent increases with rises in temperature and then decreases with further rises in temperature. The maximal value of the loss tangent and the temperature at which the loss tangent reaches the maximum vary, depending on the material.

In the conventional image forming apparatus, as shown in FIG. 4, the curve C11 indicating the relation between loss tangent and temperature of the contact layer and the curve C12 indicating the relation between loss tangent and temperature of the support layer do not intersect with each other in the range of not lower than 25° C. and not higher than 45° C. (temperature range during actual use of the image forming apparatus). Hence, there is relatively a large difference between the loss tangent of the contact layer and the loss tangent of the support layer in the range of not lower than 25° C. and not higher than 45° C. When the loss tangent of the contact layer and the loss tangent of the support layer are different as above, a vibration that is generated by the contact of the contact layer with the surface of the photosensitive drum is reflected on a boundary between the contact layer and the support layer, as shown in FIG. 6. Therefore, a stationary wave is generated in the contact layer due to the vibration generated between the contact layer and the surface of the photosensitive drum and the vibration reflected on the boundary between the contact layer and the support layer. Hence, in addition to a stick-slip vibration which is normally generated by a slide of the contact layer on the surface of the photosensitive drum, a micro vibration is generated in the contact layer due to the stationary wave, thus leading to large development in abrasion of the contact layer.

On the other hand, in the image forming apparatus 10, the curve C1 indicating the relation between loss tangent and temperature of the contact layers 34*a* and 48*a* and the curve C2 indicating the relation between loss tangent and temperature of the support layers 34*b* and 48*b* intersect with each other in the range of not lower than 25° C. and not higher than 45° C. (temperature range during actual use of the image forming apparatus). Further, the maximal value of the loss tangent on the curve C1 is smaller than the maximal value of the loss tangent on the curve C2. Further, the temperature T1 at which the loss tangent on the curve C1 reaches the maximum is smaller than the temperature T2 at which the loss tangent on the curve C2 reaches the maximum. In the range of not lower than 25° C. and not higher than T0, the loss tangent on the curve C2 is larger than the loss tangent on the curve C1, in the range of not lower than T0 and not higher than 45° C., the loss tangent on the curve C1 is larger than the loss tangent on the curve C2. The curves C1 and C2 as described above intersect with each other at the temperature T0 which is higher than the temperature T1 at which the loss tangent on the curve C1 reaches the maximum and the temperature T2 at which the loss tangent on the curve C2 reaches the maximum.

As described above, since the curve C1 and the curve C2 intersect with each other in the range of not lower than 25° C. and not higher than 45° C., a difference between the loss tangent on the curve C1 and the loss tangent on the curve C2 is small in the range of not lower than 25° C. and not higher than 45° C. For this reason, vibrations that are generated by the contacts of the contact layers 34*a* and 48*a* with the surface of the photosensitive drum 4K bring about no large reflection on boundaries between the contact layer 34*a* and the support layer 34*b* and between the contact layer 48*a* and the support layer 48*b*, and the vibrations enter the support layers 34*b* and 48*b*, as shown in FIG. 7. Since the support layers 34*b* and 48*b* have low hardness as compared with the contact layers 34*a* and 48*a*, the vibrations attenuate and disappear in the support layers 34*b* and 48*b*. This results in suppression of generation of micro vibrations in the contact layers 34*a* and 48*a*, thereby preventing large development in abrasion of the contact layers 34*a* and 48*a*.

Test Results

The present inventors conducted a test, which will be described below, so as to prove that the blade member 34, the cleaner 9, and the image forming apparatus 10 have the advantages as described above.

The present inventors produced first to seventh examples of the blade members 34 and first to third comparative examples. Then, the examples were brought into contact with the photosensitive drum as blade members for cleaning the photosensitive drum, and thereafter, abrasion or non-abrasion of the blade members and occurrence or non-occurrence of failure in cleaning the photosensitive drum were checked. Table 1 shows conditions for the first to seventh examples the blade member 34 and the first to third comparative examples. In the test, as the contact layers of the examples, polyurethane rubber blades manufactured by SYNZTEC CO., LTD., with commodity numbers indicated in Table 1, were used. Further, in order to realize support layers varying from each other in hardness, for pre-polymers and hardeners constituting the support layers, the kinds of materials used and the mixing ratio of the materials were varied.

TABLE 1

| | Hardness of Contact Layer | Commodity No. of Contact Layer | Hardness of Support Layer | Curve Intersection Temperature |
|---|---|---|---|---|
| Example 1 | 80 | UW137 | 72 | 25° C. |
| Example 2 | 77 | 201777 | 67 | 31° C. |
| Example 3 | 77 | 201729 | 70 | 42° C. |
| Example 4 | 80 | UW137 | 72 | 45° C. |
| Example 5 | 75 | 201740 | 69 | 36° C. |
| Example 6 | 80 | UW137 | 80 | 32° C. |
| Example 7 | 75 | 201740 | 75 | 35° C. |
| Comparative Example 1 | 80 | UW137 | 72 | −3° C. |
| Comparative Example 2 | 77 | 201777 | 68 | −5° C. |
| Comparative Example 3 | 79 | UW137 | 70 | 51° C. |

In Table 1, the "curve intersection temperature" means a temperature at which the curve showing the relation between loss tangent and temperature of the contact layer intersects with the curve showing the relation between loss tangent and temperature of the support layer.

The details of the test conditions are listed below.

The image forming apparatus used was an altered bizhub C650 (65 pieces of A4Y/min., 600 dpi) manufactured by Konica Minolta Business Technologies, Inc.;

the pressure with which the press member pushed the solid lubricant onto the brush was 4 N/m;

the pressure the cleaning blade member applied to the photosensitive drum was 25 N/m2;

the angle formed by the cleaning blade member and the photosensitive drum (angle □1 shown in FIG. 2) was 15 degrees;

the pressure the leveling blade member applied to the photosensitive drum was 25 N/m2;

the angle formed by the leveling blade member and the photosensitive drum (angle □2 shown in FIG. 2) was 135 degrees;

as the developer, a two-component developer made up of toner and carriers were used;

the toner was negative charged; and the test was conducted under temperature of 23° C. and humidity of 65%.

Under the above conditions, the image forming apparatus was operated to print a chart with an image density of 5% continuously. As for determination on abrasion of the blade member, after the photosensitive drum was rotated 600000 times, the abraded width of the cleaning blade member was measured by microscope observation. When the abraded width was not larger than 20 μm, it was considered that abrasion had not occurred and evaluated as "A". When the abraded width was larger than 20 μm and not lager than 30 μm, it was considered that abrasion had occurred at a non-problematic level and evaluated as "B". When the abraded width was larger than 30 μm, it was considered that problematic abrasion had occurred and evaluated as "C".

After the determination on abrasion was made, a stripe image having a length of 100 mm with an image density of 100% was printed with the same cleaning blade member used, and it was determined whether or not cleaning failure occurred. Then, when the cleaning failure did not occur, it was evaluated as "A". When the cleaning failure occurred at a non-problematic level, it was evaluated as "B". When the cleaning failure occurred at a problematic level, it was evaluated as "C". Table 2 shows the test results.

TABLE 2

| | Abrasion | Cleaning Failure |
|---|---|---|
| Example 1 | A | A |
| Example 2 | A | A |
| Example 3 | A | A |
| Example 4 | A | A |
| Example 5 | B | A |
| Example 6 | A | C |
| Example 7 | B | C |
| Comparative Example 1 | C | B |
| Comparative Example 2 | C | C |
| Comparative Example 3 | C | C |

As shown in Table 2, in the first to seventh examples of the blade member 34, abrasion at a problematic level did not occur since the curve intersection temperature was within the range of not lower than 25° C. and not higher than 45° C.

On the other hand, in the first to third comparative examples, abrasion at a problematic level occurred since the curve intersection temperature was not within the range of not lower than 25° C. and not higher than 45° C. It is, therefore, found that by setting the curve intersection temperature within the range of not lower than 25° C. and not higher than 45° C., occurrence of abrasion at a problematic level can be prevented.

Further, in the first to fifth examples of the blade member 34, cleaning failure at a problematic level did not occur. This is because the hardness of the contact layer was higher than the hardness of the support layer. According to Tables 1 and 2, it is found that occurrence of cleaning failure at a problematic level can be prevented when the blade member satisfies the following conditions: the curve intersection temperature is within the range of not lower than 25° C. and not higher than 45° C.; the hardness of the contact layer is within the range of not lower than 75° and not higher than 80°; the hardness of the support layer is in the range of not lower than 67° and not higher than 72°; and the difference between the hardness of the contact layer and the hardness of the support layer is not smaller than 6. The hardness is a measurement value obtained by means of a JIS A-type hardness scale.

A reason why occurrence of cleaning failure can be suppressed when the hardness of the contact layer is higher than the hardness of the support layer will be considered below. The higher the hardness of the contact layer, the smaller the nip width of the blade member, and hence, the higher the peak pressure inside the blade nip. For this reason, the force of scraping toner of the blade becomes large, to suppress cleaning failure. Therefore, the hardness of the contact layer is desirably higher than the hardness of the support layer.

Other Embodiments

The blade member, the cleaner and the image forming apparatus according to the present invention are not restricted to those described in the above embodiment. The configuration of the blade member 48 may be the same as the configuration of the blade member 34. In this case, abrasion of the blade member 48 also can be suppressed.

Further, the blade member 34 may be used as a blade member for the cleaner 17.

Although the present invention has been described in connection with the preferred embodiments above, it is to be noted that various changes and modifications are possible to those who are skilled in the art. Such changes and modifications are to be understood as being within the scope of the invention.

What is claimed is:

1. A blade member comprising:

a contact layer in contact with a surface of an image carrier and a support layer superimposed on the contact layer, wherein a first curve indicating a relation between loss tangent and temperature of the contact layer and a second curve indicating a relation between loss tangent and temperature of the support layer intersect with each other in a temperature range of not lower than 25° C. and not higher than 45° C. and wherein the first curve reaches a maximum at a first temperature and the second curve reaches a maximum at a second temperature, the first temperature being lower than the second temperature.

2. The blade member according to claim 1, wherein the first curve and the second curve intersect with each other at a temperature which is higher than a temperature at which the loss tangent on the first curve reaches the maximum and a temperature at which the loss tangent on the second curve reaches the maximum.

3. The blade member according to claim 1, wherein a hardness of the support layer is lower than a hardness of the contact layer.

4. The blade member according to claim 3, wherein:

the hardness of the contact layer is not lower than 75° and not higher than 80°;

the hardness of the support layer is not lower than 67° and not higher than 72°; and a difference between the hardness of the contact layer and the hardness of the support layer is not smaller than 6.

5. The blade member according to claim 1, wherein the contact layer removes toner adhering to the surface of the image carrier.

6. The blade member according to claim 1, wherein the contact layer levels off a lubricant applied to the surface of the image carrier.

7. A cleaner for cleaning a surface of the image carrier, comprising the blade member according to claim 1.

8. An image forming apparatus comprising the cleaner according to claim 7.

9. The blade member according to claim 1, wherein a maximal value of the loss tangent on the first curve is not less than 0.4.

10. The blade member according to claim 1, wherein the second curve intersects with the first curve at two temperatures both of which are higher than the first temperature.

11. A blade member comprising:

a contact layer in contact with a surface of an image carrier and a support layer superimposed on the contact layer, wherein a first curve indicating a relation between loss tangent and temperature of the contact layer and a second curve indicating a relation between loss tangent and temperature of the support layer intersect with each other in a temperature range of not lower than 25° C. and not higher than 45° C., wherein a maximal value of the loss tangent on the first curve is smaller than a maximal value of the loss tangent on the second curve, and wherein the first curve reaches a maximum at a first temperature and the second curve reaches a maximum at a second temperature, the first temperature being lower than the second temperature.

12. The blade member according to claim 11, wherein the first curve and the second curve intersect with each other at a temperature which is higher than a temperature at which the loss tangent on the first curve reaches a maximum and a temperature at which the loss tangent on the second curve reaches a maximum.

13. The blade member according to claim 11, wherein a hardness of the support layer is lower than a hardness of the contact layer.

14. The blade member according to claim 13, wherein:

the hardness of the contact layer is not lower than 75° and not higher than 80°;

the hardness of the support layer is not lower than 67° and not higher than 72°; and a difference between the hardness of the contact layer and the hardness of the support layer is not smaller than 6.

15. The blade member according to claim 11, wherein the contact layer removes toner adhering to the surface of the image carrier.

16. The blade member according to claim 11, wherein the contact layer levels off a lubricant applied to the surface of the image carrier.

17. A cleaner for cleaning a surface of the image carrier, comprising the blade member according to claim 11.

18. An image forming apparatus comprising the cleaner according to claim 17.

19. The blade member according to claim 11, wherein the maximal value of the loss tangent on the first curve is not less than 0.4.

20. The blade member according to claim 11, wherein the second curve intersects with the first curve at two temperatures both of which are higher than the first temperature.

* * * * *